US008998516B2

(12) United States Patent
Mo et al.

(10) Patent No.: US 8,998,516 B2
(45) Date of Patent: Apr. 7, 2015

(54) TANDEM PRINTING SYSTEM HAVING A WEB TRANSPORT CONTROLLER WITH A DERIVED DRUM DIAMETER

(75) Inventors: Song-Feng Mo, Webster, NY (US); Yongsoon Eun, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 301 days.

(21) Appl. No.: 13/415,044

(22) Filed: Mar. 8, 2012

(65) Prior Publication Data

US 2013/0233191 A1 Sep. 12, 2013

(51) Int. Cl.

| | |
|---|---|
| ***B41J 15/16*** | (2006.01) |
| ***G03G 15/00*** | (2006.01) |
| ***B65H 23/04*** | (2006.01) |

(52) U.S. Cl.

CPC ..... *B41J 15/16* (2013.01); *B65H 23/042* (2013.01)

(58) Field of Classification Search

CPC ..... B41J 15/04; B41J 15/16; B41J 15/005; B65H 23/042; B41F 5/06; G03G 15/652

USPC ..... 347/104; 400/611, 618; 399/387, 384; 101/219

See application file for complete search history.

(56) References Cited

U.S. PATENT DOCUMENTS

| | | | | |
|---|---|---|---|---|
| 5,402,957 | A | 4/1995 | Evans | |
| 6,297,886 | B1 | 10/2001 | Cornell | |
| 6,476,923 | B1 | 11/2002 | Cornell | |
| 6,567,621 | B2 * | 5/2003 | Miyoshi et al. | 399/19 |
| 6,799,507 | B2 * | 10/2004 | Ohba et al. | 101/228 |
| 7,038,808 | B2 | 5/2006 | Yamakado et al. | |
| 7,665,817 | B2 | 2/2010 | Folkins | |
| 2009/0086221 | A1 | 4/2009 | Silverbrook et al. | |
| 2010/0194028 | A1 | 8/2010 | Frisque | |
| 2011/0199414 | A1 | 8/2011 | Lang | |
| 2011/0280638 | A1 | 11/2011 | Eun | |

FOREIGN PATENT DOCUMENTS

JP 09207322 A * 8/1997

* cited by examiner

*Primary Examiner* — Daniel J Colilla
*Assistant Examiner* — John M Royston
(74) *Attorney, Agent, or Firm* — Maginot Moore & Beck LLP

(57) ABSTRACT

A tandem printing system for imaging a continuous web of material includes a first printer serially coupled to a second printer wherein the speed of the web can be adjusted to maintain image quality and to compensate for a change in a diameter of a driver drum. The change in the diameter of the driver drum can be derived from characteristics of the printing system including the amount of sag of the continuous web of material moving between the first printer and the second printer.

5 Claims, 4 Drawing Sheets

TANDEM PRINTING SYSTEM HAVING A WEB TRANSPORT CONTROLLER WITH A DERIVED DRUM DIAMETER

TECHNICAL FIELD

This disclosure relates generally to a tandem printing system for imaging a continuous web of print media, and more particularly to a tandem printing system moving the continuous web of print media from a first print engine to a second print engine.

BACKGROUND

Inkjet printers operate a plurality of inkjets in each printhead to eject liquid ink onto an image receiving surface. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the image receiving surface. In these solid ink printers, also known as phase change inkjet printers, the solid ink can be in the form of pellets, ink sticks, granules, pastilles, or other shapes. These solid forms are denoted by the term "solid ink sticks" in this document. The solid ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to a gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface can be the surface of a continuous web of recording media, a series of media sheets, or the surface of an image receiving member, which can be a rotating print drum or endless belt. In an inkjet printhead, individual piezoelectric, thermal, or acoustic actuators generate mechanical forces that expel ink through apertures, usually called nozzles, which are arranged in a faceplate of the printhead. The actuators expel an ink drop in response to an electrical signal, sometimes called a firing signal. The amplitude or duration of the firing signals affects the amount of ink ejected in an ink drop. The firing signal is generated by a printhead controller with reference to image data.

A print engine in an inkjet printer is comprised of a processor that executes instructions stored in a memory operatively connected to the processor to process image data also stored in a memory operatively connected to the processor to identify the inkjets in the printheads of the printer that are operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

Phase change inkjet printers form images using either a direct or an offset print process. In a direct print process, melted ink is jetted directly onto recording media to form images. In an offset print process, also referred to as an indirect print process, melted ink is jetted onto a surface of a rotating member such as the surface of a rotating drum, belt, or band. Recording media are moved proximate the surface of the rotating member in synchronization with the ink images formed on the surface. The recording media are then pressed against the surface of the rotating member as the media passes through a nip formed between the rotating member and a transfix roller. The ink images are transferred and affixed to the recording media by the pressure in the nip. This process of transferring an image to the media is known as a "transfix" process.

A known system for ejecting ink to form images on a moving web of media material is shown in FIG. 4. The system 10 includes a web unwinding unit 14, a printing apparatus 18, and a cutting station 22. In brief, the web unwinding unit 14 includes an actuator, such as an electrical motor, that rotates a roll of media material in a direction that removes a web 26 of media material from the unwinding unit 14. The web 26 is fed through the printing apparatus 18 along a path, which extends to the cutting station 22. The printer, referred to as a printing apparatus 18, treats the web 26 to remove debris and loose particulate matter from the web surface, ejects ink using data and signals generated by one or more print engines onto the moving web to form ink images. A print engine can include one or more marking stations having one or more printheads. Once the printed image has been applied to the web, the printer fixes the printed image to the web. The marking stations can be configured to eject different colored inks onto the web 26 to form a composite colored image. In one system 10, the marking stations eject cyan, magenta, yellow, and black ink for forming composite colored images. The web 26 is then pulled into the cutting station 22, which cuts the web into sheets for further processing.

The printing apparatus 18 is configured with one or more processors, programmed instructions, and electronic components to implement a registration control method that controls the timing of the ink ejections onto the web 26 as the web passes the marking stations. One known registration control method that may be used to operate the marking stations in the printing apparatus 18 is the single reflex method. In the single reflex method, the rotation of a single roller at or near a marking station is monitored by an encoder. The encoder may be a mechanical or electronic device that measures the angular velocity of the roller and generates a signal corresponding to the angular velocity of the roller. The angular velocity signal is processed by a controller executing programmed instructions for implementing the single reflex method to calculate the linear velocity of the web. The controller may adjust the linear web velocity calculation by using tension measurement signals generated by one or more loadcells that measure the tension on the web 26 near the roller. The controller implementing the single reflex method is configured with input/output circuitry, memory, programmed instructions, and other electronic components to calculate the linear web velocity and to generate the firing signals for the printheads in the marking stations.

Another known registration control method that may be used to operate the marking stations in the printing apparatus 18 is the double reflex method. In the double reflex method, two rollers are monitored by an encoder. One roller lies on the web path before the marking stations and the other roller lies on the web path following the marking stations. The angular velocity signals generated by the encoders for the two rollers are processed by a controller executing programmed instructions for implementing the double reflex method to calculate the linear velocity of the web 26 at each roller and then to interpolate the linear velocity of the web at each of the marking stations. These additional calculations enable better timing of the firing signals for the printheads in the marking stations and, consequently, improved registration of the images printed by the marking stations in the printing apparatus 18.

To address demand for printing systems that use a large number of colored inks, some printing systems include more than one printing apparatus. For instance, in a tandem printing system, a tandem printing system can include two of the printing apparatus 18, such as the one shown in FIG. 4, arranged in a tandem configuration. The tandem configuration enables the marking stations in each of the two printing apparatus 18 to use different colored inks. Additionally, a web inverter may be positioned between the two printing apparatus 18 to enable the web to be turned over so the reverse surface of the web may be printed by the second printing system. The tandem printing system configuration enables the entire width of the reverse side of the web to be printed.

One issue encountered in printing systems having a first printing apparatus and a second printing apparatus arranged serially in tandem is the need to synchronize the registration of images being printed by the first and the second printing apparatus. If the two serially connected printing apparatus 18 form images on the same side of the web, then slight differences in the printed images can adversely impact image quality. Even when the two printing apparatus 18 form images on different sides of the web, registration is still important because the duplex printed web is cut into individual, double-sided printed pages. If the registration of images is not accurately controlled, an image on one side of the web may creep over the length of a print job into the cutting zone between images.

In a tandem web printing system, two print engines with one engine being located in each printer, should print images on the web at substantially the same speed. Each of the print engines includes a print driver, typically a drum, coupled to a motor to move the web past respective printheads. By coordinating the speed of the first print engine with the speed of the second print engine, the amount of web located between the first and the second printer can be controlled to prevent the web from tearing during printing or falling to a floor or another location situated between printers. In some tandem printing systems a web buffer, also known as a loop box, provides for web transport between the first printer to the second printer. The web buffer accommodates a certain amount of slack, or sag, that can be present between print engines should the print engines be running at different speeds or should certain system components be deficient to meet design constraints. The web buffer includes a sensor to detect the depth, or amount of sag, of a loop of web material passing between two rollers. If the detected depth falls outside a predetermined maximum depth, print engine speed can be adjusted to maintain acceptable tandem printing system web motion. Since the performance of printing process registration can be directly related to a change in speed over time between the print engines and respective print drivers, a smaller change in speed over time provides for a better registration performance. On the other hand, a smaller change in speed over time can necessitate a larger loop control box since the amount of slack or the depth of the loop in the loop control box can become excessive. Consequently, improvements to the registration of the images printed by the two printing apparatus on a single web would be desirable. Thus, accurate control of one print engine with respect to another print engine in a tandem printing system is desirable.

SUMMARY

In a tandem web printing system, the speed of a first print engine and the speed of a second print engine can be controlled without measuring a physical diameter of the print driver drums of each print engine. The printing system for printing images on a continuous web includes a first printer configured to print an image on the continuous web. The first printer includes a first driver to move the continuous web through the first printer. The printing system includes a second printer, operatively connected to the first printer and configured to print a second image on the continuous web. The second printer includes a second driver to move the continuous web through the second printer. A web buffer is operatively connected to the first printer and the second printer to transport the continuous web from the first printer to the second printer. The web buffer includes a sensor to detect sag in the continuous web. A controller is operatively connected to the first driver, the sensor, and the second driver. The controller is configured to adjust a speed of at least one of the first driver and the second driver in response to a change in the amount of sag of the continuous web at the web buffer resulting from a dimensional change to one of the first driver and the second driver.

A method to control the print speed of a first print engine of a first printer connected serially to a second print engine of a second printer can minimize registration errors occurring as a result of the diameter of driver drums varying over a period of time. The method can control the speed of a moving web with a first rotating driver and a second rotating driver in a tandem printing system having a first printer and a second printer. The method includes determining a constant rotational speed of the first rotating driver during movement of the web moving between the first printer and the second printer at a constant rate of speed; calculating a change in the amount of sag of the web between the first printer and the second printer over a measured period of time; calculating a change in a diameter of the first rotating driver based on the constant rotational speed, the calculated change in the amount of sag, and the measured period of time; and adjusting the rate of speed of the web using the calculated change in diameter of the first rotating driver.

In another embodiment, a method of adjusting the registration of a first image made by a first print engine with a second image made by a second print engine on a moving web transported between a first driver drum and a second driver drum is provided in a tandem printing system. The method includes setting the diameters of the first driver drum and the second driver drum to a first default value and a second default value respectively; controlling rotation of the first driver drum using the first default value and rotation of the second driver drum using the second default value to achieve a steady state speed of the moving web; determining a change in an amount of sag of the web located between the first driver drum and the second driver drum; setting the diameter of one of the first driver drum and the second driver drum to an updated diameter value based on the determined amount of sag of the transported web; and controlling rotation of the first driver drum using one of the updated diameter value and the first default value and rotation of the second driver drum using one of the updated diameter value and the second default value.

BRIEF DESCRIPTION OF THE DRAWINGS

The foregoing aspects and other features of a tandem printing system that utilizes a derived driver diameter to control the motion of a material web is explained in the following description, taken in connection with the accompanying drawings.

DETAILED DESCRIPTION

Figure 1:
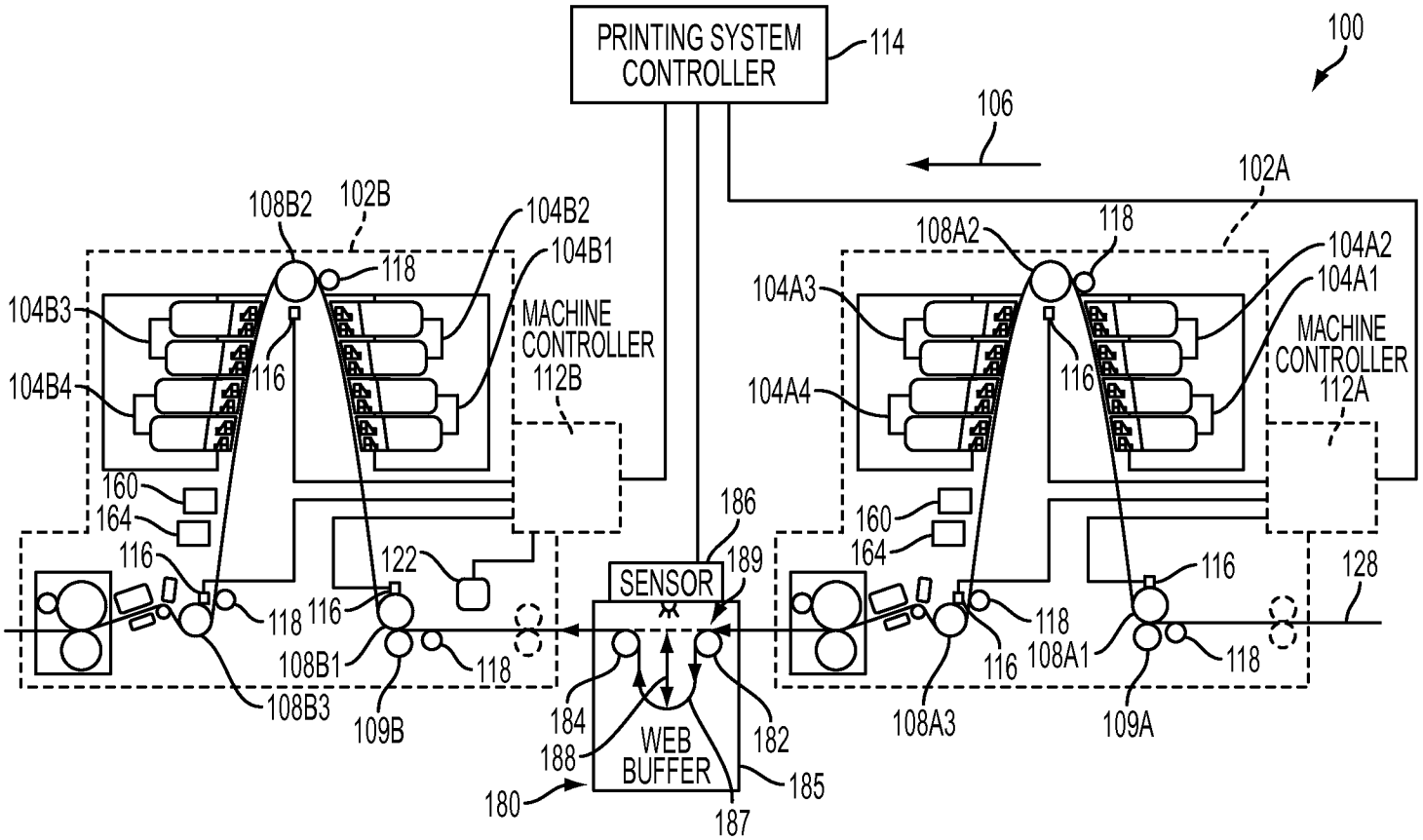
FIG. 1 schematic side view of a tandem printing system having a first printer and a second printer serially connected to print images on a continuous web of print media.

For a general understanding of the environment for the system and method disclosed herein as well as the details for the system and method, reference is made to the drawings. In the drawings, like reference numerals have been used throughout to designate like elements. As used herein the term "printer" and "printing apparatus", which may be used interchangeably, refer to any device that produces ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various recording media including paper. Furthermore, as used herein, the term "tandem printing system" refers to a system in which two or more printers or print engines are configured serially to enable web media to pass through the printers along a contiguous path so the web media printed by one printer may be subsequently printed upon by another printer with accurate registration of images.

As shown in FIG. 1, a continuous feed tandem printing system 100 is shown with two serially connected printing apparatus 102A and 102B, which print images on a continuous web 128 of print media. The printing apparatus 102A and 102B include processors configured with instructions stored in a memory operatively connected to the processor that enable the processor to implement processes that render image data for the generation of firing signals to form ink images that correspond to image data. Processors configured in this manner are known as "print engines". In addition, each printing apparatus can be a stand-alone printer modified to operate as a tandem system or can be designed to operate only within a tandem printing system. The continuous web 128 moves through the printing system 100 from the printing apparatus 102A to the printing apparatus 102B in a process direction 106. Both printing apparatus 102A and 102B use a reflex registration system for the generation of printhead firing signals to register ink ejected by printhead arrays that follow other printhead arrays in the process direction. The reflex registration system in each apparatus 102A and 102B determines the composite linear velocity of the web 128 as the web moves through an apparatus in order to synchronize the timing of the firing signals and the ejection of the ink onto the web. The printing apparatus 102A determines a composite linear velocity with reference to the angular velocity of rollers, drums, and tension measurements for the web 128 within the apparatus 102A. The printing apparatus 102B determines a composite linear velocity of the web 128 based at least in part on an angular velocity of a roller or drum within the apparatus 102B. The tandem printing system 100 as depicted in FIG. 1 includes only two printing apparatus 102A and 102B to facilitate the discussion. Any number of printing apparatus, however, can be connected serially, or in tandem.

The apparatus 102A and 102B can implement either a single reflex or a double reflex registration system to time the delivery of firing signals to printheads in a print zone of a web printing system. "Double reflex registration system" refers to a system that uses the angular velocity signals corresponding to the rotation of two or more rollers or driver drums, as described herein, to compute the web velocity at a printhead positioned between the rollers. A single reflex registration system refers to a system that uses the angular velocity signals corresponding to the rotation of only one roller or driver drum to compute a linear web velocity that is used to predict web positions and timing in a print zone. A double reflex control system is described in U.S. Pat. No. 7,665,817, which is entitled "Double Reflex Printing" and which issued on Feb. 23, 2010 and is owned by the assignee of the present application.

The printing apparatus 102A of FIG. 1 includes marking stations 104A1, 104A2, 104A3, 104A4; rollers 108A1, 108A2, 108A3; driver drum 109A; a machine controller 112A; a printing system controller 114; encoders 116; loadcells 118; an ink leveling device 160; and an ink curing device 164. The marking stations 104A1, 104A2, 104A3, 104A4 are mechanically connected to a printer frame and electronically connected to the machine controller 112A. The marking stations 104A1, 104A2, 104A3, 104A4 are configured to eject droplets of liquid ink onto the continuous web 128 of print media for direct printing in response to receiving firing signals from the controller 112A. The rollers 108A2 and 108A3, which are connected to the printer frame for rotation about a longitudinal axis, are rotated by the continuous web 128 as the web moves through the printing apparatus 102A along a web path. A driver drum 109A is coupled to a motor (not shown), which rotates the driver drum 109A at an angular velocity specified by the controller 114. The drum 109A moves the continuous web 128 in the direction 106.

A print zone extends from the roller 108A1 to the roller 108A2 and from the roller 108A2 to the roller 108A3. The encoders 116 generate an angular velocity signal corresponding to an angular velocity of a respective one of the rollers 108A1, 108A2, and 108A3, and driver drum 109A. Each encoder 116 can be a mechanical or electronic device as known to those of ordinary skill in the art. An electrical output of each encoder 116 is processed by a converter (not shown), which converts a respective one of the angular velocity signals to a linear velocity signal. The loadcells 118 generate electronic signals indicative of a tension of the web near the loadcells.

The printing system controller 114 is configured to receive and/or generate image printing scheduling data, among other functions, and is electrically operatively connected to the controller 112A and a controller 112B in the printing system 100. The controller 114 may be configured to coordinate the operation of two or more printing apparatus 102A, 102B. The machine controller 112A generates firing signals with reference to the linear velocity at each point of the continuous web 128 proximate to a marking station. The controller 112A is associated with only the printing apparatus 102A. The ink leveling device 160 and the ink curing device 164 are connected to the printer frame subsequent to the marking stations to prepare certain inks for document distribution.

As also shown in FIG. 1, the printing apparatus 102B includes marking stations 104B1, 104B2, 104B3, 104B4; rollers 108B1, 108B2, 108B3; driver drum 109B; a machine controller 112B; encoders 116; loadcells 118; an ink leveling device 160; and an ink curing device 164, which are each connected and configured to function similarly to the like components described with reference to the printing apparatus 102A. The printing apparatus 102B, includes the machine controller 112B, which is associated with only the printing apparatus 102B, and which is connected to the system controller 114. Additionally, the printing apparatus 102B can include a sensor 122 configured to detect fiducial marks printed on the continuous web 128 by the printing apparatus 102A.

The marking stations 104A1, 104A2, 104A3, 104A4, 104B1, 104B2, 104B3, 104B4, sometimes referred to as printhead arrays, each include an ink reservoir, inkjet ejectors, and nozzles as known to those of ordinary skill in the art, but not illustrated in FIG. 1. The nozzles are fluidly connected to the ink reservoir to receive liquid ink from the ink reservoir. The inkjet ejectors receive firing signals from one of the controllers 112A, 112B in a known manner and, in response, eject ink droplets onto the continuous web 128. The inkjet ejectors can be thermal inkjet ejectors, piezoelectric inkjet ejectors, or any other inkjet ejector known to those of ordinary skill in the art. Although the marking stations shown are in the form of sets of inkjet arrays, each marking station corresponds to one primary color or other type of marking material. Other types of marking stations and arrangements are possible, however, such as each marking station being capable of printing multiple colors or types and/or one or more marking stations utilizing electrophotography or ionography. Additionally, each of the marking stations 104A1, 104A2, 104A3, 104A4, 104B1, 104B2, 104B3, 104B4 is associated with only one of the printing apparatus 102A, 102B.

The rollers 108A1, 108A2, 108A3, 108B1, 108B2, 108B3 can be any type of roller configured to guide the continuous web 128, as known to those of ordinary skill in the art. As shown in FIG. 1, the roller 108B1 is positioned before the marking stations 104B1, 104B2, 104B3, 104B4 in the direction of web motion and the roller 108B2 is positioned after the marking stations 104B1, 104B2 and before the marking stations 104B3, 104B4 in the direction of web motion. Similarly, the roller 108B3 is positioned after the marking stations 104B1, 104B2, 104B3, 104B4 in the direction of web motion. A driver drum 109B is coupled to a motor (not shown), which rotates the roller 109B at an angular velocity specified by the controller 114. The driver drum 109B moves the continuous web 128 in the direction 106.

The printing system 100 also includes a web buffer 180 to transport the continuous web 128 from an output of the printer 102A to an input of the printer 102B. The web buffer 180 supports a first roller 182 and a second roller 184 for rotation each of which support the continuous web 128 along the transport path between printers. The web buffer includes a frame 185 to support the rollers 182 and 184 for rotation and also to support a sensor 186.

As the web 128 moves from the roller 182 to the roller 184, the web 128 can develop a sag 187 located between the two rollers. The sag 187 can arise for a variety of reasons generally related to a difference in the transport speed of the continuous web 128 between the driver drum 109A of printer 102A and the driver drum 109B of printer 102B. The difference in transport speed between the printers 102A and 102B can result from dimensional changes to the drivers. For instance, the actual diameter of one or both of the driver drums can be different than a predetermined diameter of a driver drum. Differences in transport speed can also result from driver drum diameters changing over a period of time or the encoders 116 losing calibration.

The sensor 186, which can include a laser sensor, monitors the amount of sag of the web, having a depth 188, taken between a low point of the web within the web buffer 180 and a predetermined point or location, for instance line 189. Other predetermined locations for sensing the amount of sag can be used. By monitoring and determining the amount or depth of the sag, the angular velocity of the driver drum 109A and 109B can be controlled to provide for synchronized imaging between the first printer 102A and the second printer 102B. Should the amount of sag become too large, the printer 102A and the printer 102B can be shut down for maintenance to determine the cause of the mismatch in the transport speed of the web between the printers. In one embodiment, the sag varies from a depth of 10 mm to 20 mm Other amounts of sag are also possible.

One of the potential causes of a mismatch in transport speed between the printer 102A and the printer 102B can result from wear or deterioration sustained by the driver drum 109A, the driver drum 109B, or both. When wear to a driver drum occurs, the wear can be relatively uniform about the surface of the drum contacting the recording media for transport thereby changing the circumference or diameter of the drum. In some instances, the wear to one or both of the driver drums can adversely affect the transport speed of the web from one print engine to the next, which in turn can cause image registration problems.

The diameter of a driver drum can be measured during manufacturing and that measurement can be used by the controller 114 to calibrate and maintain the transport speed of the recording media through the tandem printing system 100. While initial measurements can include a high degree of accuracy, such measurements do not take into account the fact that the contacting surfaces of the driver drums can be worn down through use and throughout the entire life cycle of the printer. While the driver drum can be removed from the system, the diameter of the drum measured to check for a change in diameter, placed back in the system, and the appropriate system controller parameters updated to reflect a new diameter, such procedures can take a considerable amount of time are not desirable in a document production environment.

Figure 2:
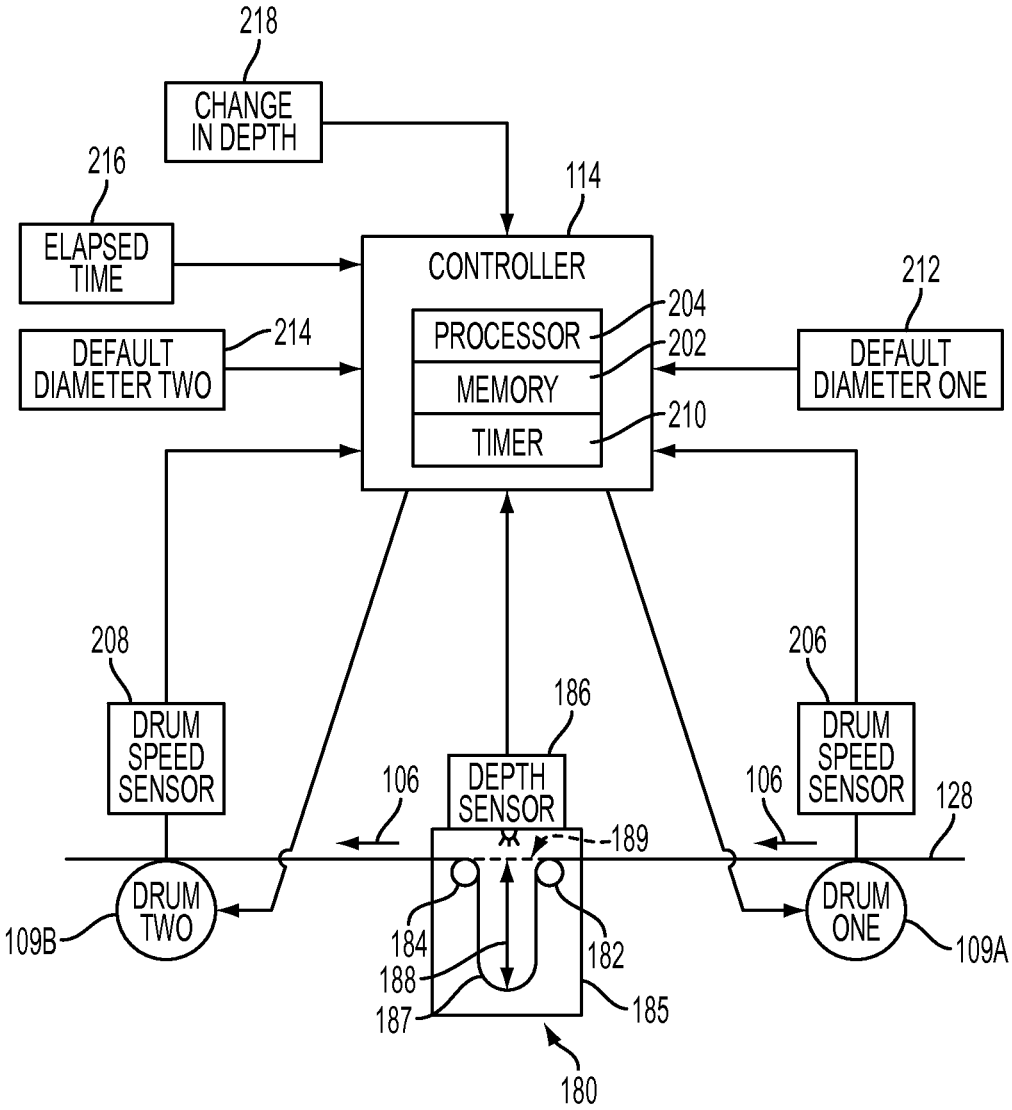
FIG. 2 is a block diagram of a web buffer, including a sensor, located between a first driver drum and a second driver drum, and a control system to control the speed of a web of material moving from the first driver drum to the second driver drum.

FIG. 2 is a block diagram of a control system to regulate the speed of a web of material moving from driver drum 109A to driver drum 109B, including the controller 114 and the web buffer 180 of FIG. 1. As shown in FIG. 2, the machine controller 114 of the printing system 100 includes an electronic memory 202 to store data and programmed instructions, which are executed with general or specialized programmable processors, such as processor 204. The components of the controller 114 can be provided on a printed circuit card or provided as a circuit in an application specific integrated circuit ("ASIC"). Each of the circuits can be implemented with a separate processor, such as the processor 204, or multiple circuits can be implemented on the same processor. Alternatively, the circuits can be implemented with discrete components or circuits provided in very-large-scale integration (VLSI) circuits. Also, the circuits described herein can be implemented with a combination of processors, ASICs, discrete components, or VLSI circuits.

The embodiment of FIG. 2. additionally illustrates the controller 114 and various components, variables, measured values, and system parameters used in a setup process to maintain a consistent web speed between the first printer 102A and the second printer 102B. The controller 114 can automatically measure the velocity of the continuous web 128 and generate an updated driver drum diameter to maintain consistent web speed between the first printer 102A and the second printer 102B. During the setup process, the loop depth 188 is measured by the sensor 186 while the web media travels past the sensor 186. The controller 114 monitors the amount of sag defined by the depth 188 over a predetermined period of time. When the controller 114 begins monitoring the amount of sag, the time at which monitoring starts is detected by a timer 210 and stored in memory 202. The timer 210 can be embodied as a stand-alone timing circuit, an integrated circuit, or a programmed timer resident in the processor 204. The time taking place during the measurement of the loop depth (elapsed time) is monitored. The change in loop depth and the elapsed time are then transmitted to the processor 204, which executes programmed instructions to implement one or more algorithms to calculate an updated driver drum diameter to establish the speed of the continuous web 128 transported from the first printer 102A to the second printer 102B.

In operation, the sensor 186 located at the top of the web buffer 180 measures the sag, or paper depth, in the loop box 180 over a period of time. The controller 114, which is coupled to the sensor 186, uses the change in depth, in conjunction with a rotational velocity sensed by a drum speed sensor 206, operatively connected to the drum 109A and/or the rotational velocity sensed by a drum speed sensor 208, operatively connected to the drum 109B. The drum speed sensor 206 and 208 can include previously described encoders 116. Signals representing the respective drum speeds sensed by drum speed sensors 206 and 208 are transmitted to the controller 114 to enable control of the speed of the continuous web 128.

The controller 114 also uses a number of predetermined values to enable adjustment of the speed of the continuous web 128 in conjunction with the sensed parameters generated by the sensor 186 and the drum speed sensors 206 and 208. The controller adjusts the speed of the web to keep the change in velocity of the web small enough to provide acceptable process direction registration performance in the downstream printer 102B, and in the meantime, keep the web depth amplitude (sag) small enough to maintain the web media within the mechanical constraints of the web buffer 180. Since the controller 114 controls the angular velocity of the driver drums 109A and 109B to maintain speed of the web of each printer 102A and 102B, the accuracy of the driver drum diameter is considered in controlling the speed of the continuous web. Without direct measurement, however, the diameter of a worn driver drum is unknown, which can affect printing performance.

To provide an accurate registration of images from printers 102A and 102B and to control the speed of the continuous web, the driver drum diameter can be assumed to be a default nominal value, D(nom), based on known design and manufacturing specifications. The default nominal value can also be a measured value of a driver drum made before the tandem printing system 100 has been assembled. A default value 212 for the diameter of drum 109A is stored in a memory and a default value 214 for the diameter of driver drum 109B is stored in memory as well. A default elapsed time 216 and a default change in depth 218 are also set and used in the setup process described herein. In one embodiment, the default elapsed time can be 100 seconds. The default change in depth can be plus or minus 50 mm from the desired value of depth of the loop.

Figure 3:
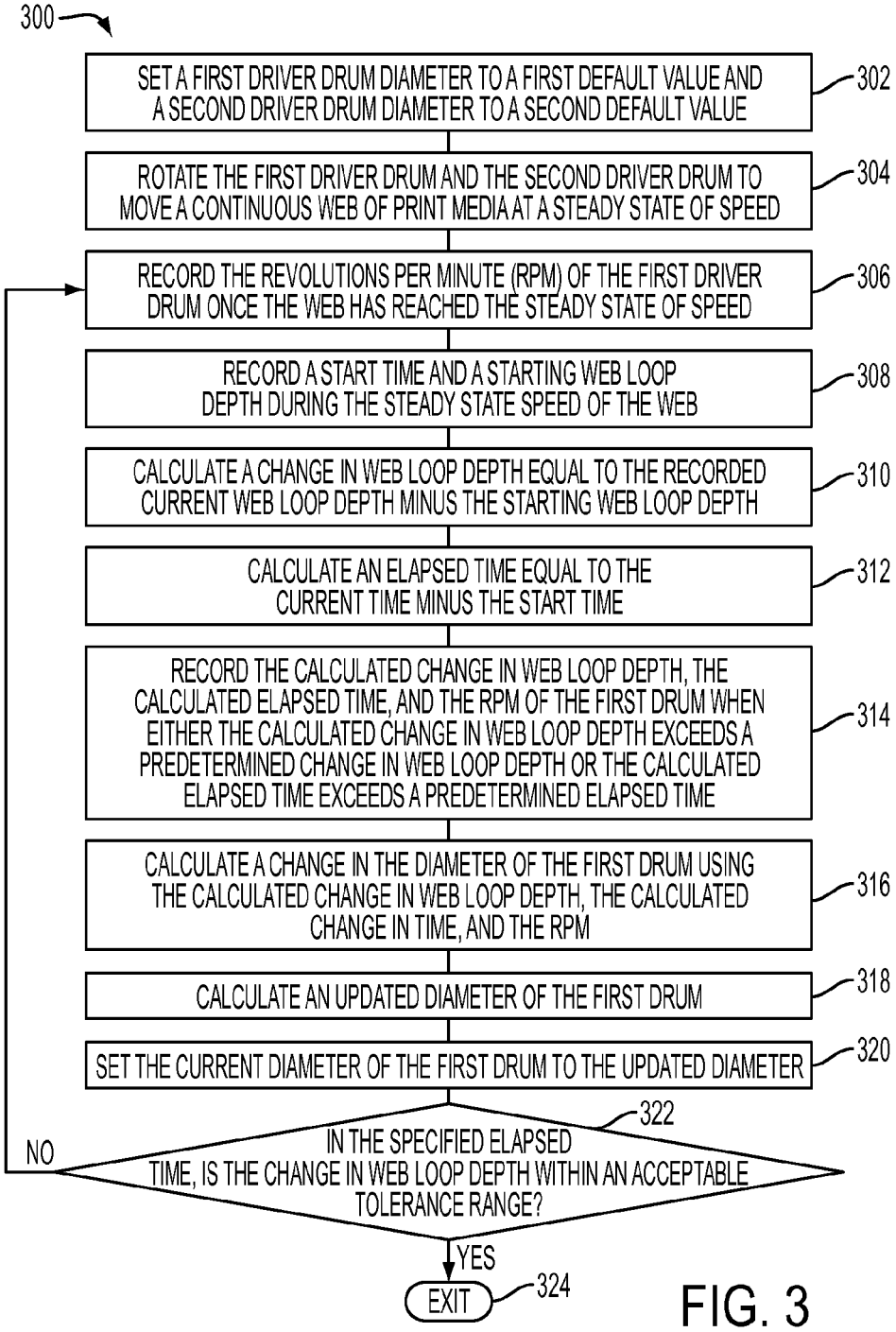
FIG. 3 is a flow diagram of a method to control the transport speed of a web of material between a first printer and a second printer in a tandem printing system.
Figure 4:
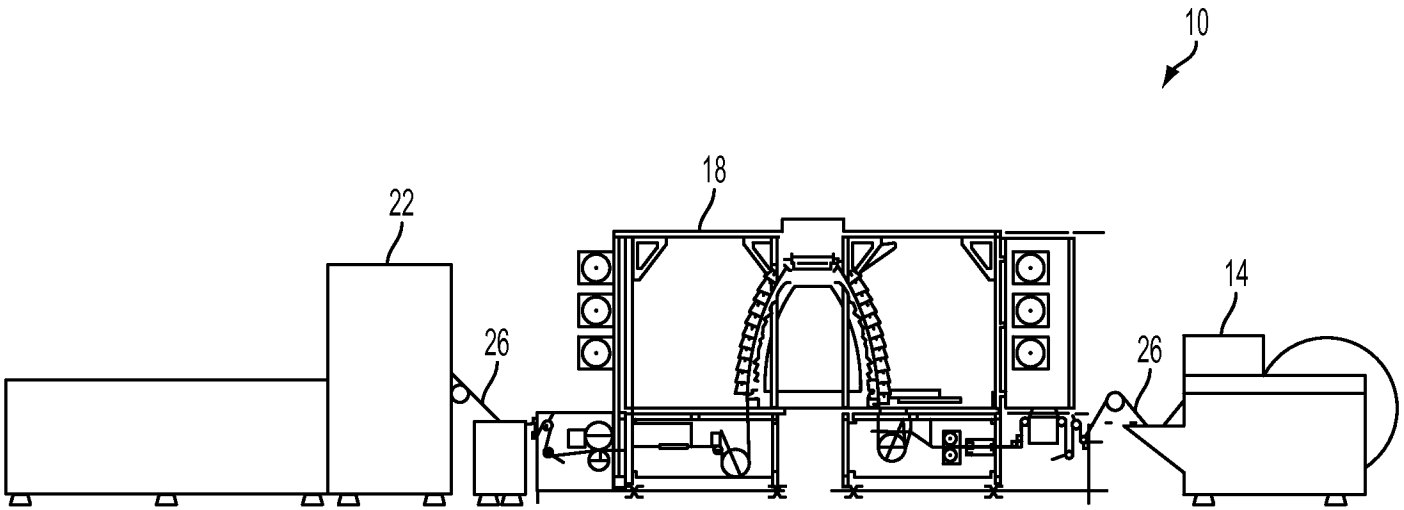
FIG. 4 PRIOR ART
FIG. 4 is schematic side view of a known printing system configured to print images on a continuous web of print media.

FIG. 3 illustrates one example of a method used to determine a driver drum diameter in the tandem printing system 100. Without losing generality, the method described with respect to FIG. 3 sets the diameter of driver drum 109B (the downstream driver drum) to a default nominal value. In one embodiment, this default nominal value remains the same throughout the lifetime of the tandem printing system. The diameter of the driver drum 109A (the upstream driver drum), however, is determined based on an initial default nominal value and later, as the system ages, a diameter derived from certain operating characteristics of the tandem printing system 100 to be described.

As illustrated in the flow diagram of FIG. 3, the respective diameters of the first driver drum 109A is set to the first default value 212, D(nom1) and the second driver drum is set the second default value 214 (block 302). The driver drum diameter default values can be measured values of the driver drums being assembled to complete a specific tandem printing system, or can be values determined based on design specifications. Once the default diameter values have been set, the controller 114 sends respective control signals to rotate the driver drum 109A and the driver drum 109B. The transmitted control signals control rotation of the driver drums to provide a steady state speed of the continuous web of print media 128 for movement through the printing system 100 (block 304). After the controller 114 determines that the web is being transported at a steady state of speed, the drum speed sensor 206 records the angular velocity, for instance, the number of revolutions per minute (RPM), of the driver drum 109A (block 306).

While the driver drums are rotating at a steady state of speed, the controller 114 records an initial, or start time, corresponding to the time when the steady state speed of the driver drum 109A is known. The controller 114, which is receiving information regarding the amount of sag, or depth 188, of the web, records and stores an initial web loop depth, substantially concurrent with the recorded start time (block 308).

The controller 114 continues to monitor the depth 188 and the amount of time taking place, or the elapsed time, since the start time was recorded. The controller 114 receives the current measurement of depth sensed by the sensor 186 to calculate a change in web loop depth with respect to the starting web loop depth (block 310). While the current amount of depth is being monitored, the controller 114 also records the current time to determine an elapsed time starting from the initial time (block 312).

While the change in web loop depth and the elapsed time are being calculated, each of these calculated parameters is being compared to a respective predetermined default value. If either the calculated change in web loop depth exceeds the default change in web loop depth 218 or if the calculated elapsed time exceeds the default elapsed time 216, then the controller 114 records and stores the calculated change in web loop depth, the calculated elapsed time, and the RPM of the first driver drum 109A (block 314).

Once the calculated change in web loop depth, the calculated elapsed time, and the RPM have been recorded, an updated diameter of the driver drum 109A can be determined (block 316). While the updated diameter of the driver drum can be determined by the execution of programmed instructions for implementing an algorithm resident in the controller 114 during operation of the printer, the updated diameter can also be calculated by an external computing device using the recorded parameters. The tandem printing system 100 can be turned off or cycled down while the updated diameter is determined.

To determine an updated diameter of the driver drum 109A, a change in diameter, DeltaDia, is determined using the calculated change in loop depth, DeltaDis, the calculated elapsed time, DeltaTime, the default nominal value of the driver drum 109A, D(nom1), and the RPM of the driver drum 109A according to the following equation:

$$\text{Delta}Dia=2\times60\times\text{Delta}Dis\times D(nom1)/(\text{RPM}\times D(nom1)\times\pi\times\text{DeltaTime}-2\times60\times\text{Delta}Dis)$$

Where π (Pi)=3.1415926

Once the change in diameter has been calculated, an updated drum diameter is determined according to the following equation where D(new) is the newly calculated diameter of driver drum 109A (block 318):

$$D(\text{new})=D(nom1)+\text{Delta}Dia$$

Once the new drum diameter, D(new), has been calculated, the operating parameters of the tandem printing system 100 are updated to include the new drum diameter (block 320). Because only one drum diameter has been determined by the equations above, the diameter for driver drum 109B remains the same as originally assigned. Once the diameter of driver drum 109A has been updated to a different value, the controller 114 can move the continuous web at an updated speed based on the new drum diameter.

Before the tandem printing system 100 is put back into operation, however, the new drum diameter, D(new), is checked to determine whether the new drum diameter value is successful in correcting print defects, including the registration of images. To accomplish the verification of a successful change to the drum diameter, the following equation is solved where TBD2 is the calculated elapsed time. TBD3 is a limit value based on an acceptable amount of change in loop depth which can occur during the calculated elapsed time, If the change in depth loop occurring during the elapsed time, TBD2, is less than a predetermined amount, then the new value of the drum diameter is acceptable. (block 322).

$$\text{If (DeltaTime)}==TBD2 \text{ and } abs(\text{Delta}Dis)<TBD3)$$

Consequently, the processing at block 322 makes a calculation to determine whether the change in web loop depth is less than an acceptable amount (within a predetermined tolerance range) measured during the specified elapsed time. For instance in one embodiment, TBD2 can be 100 seconds and TBD3 can be set to a value of 1 mm. If the above equation is satisfied, then setup of the system with the new drum diameter is determined to be successful, and the setup routine is exited (block 324). If, however, if the above equation is not satisfied, the setup routine is repeated by returning to block 306 where blocks 306 through 322 are repeated until the updated drum diameter is determined to be satisfactory.

By updating the drum diameter according to the described flow diagram and the description herein, the previous method of determining drum diameter is improved. The described setup process avoids tedious driver drum diameter direct measurements and can determine whether the diameter of a driver drum should be adjusted to reflect wear that has occurred. By deriving an updated drum diameter when necessary and throughout the operating life of the tandem printing system 100, web speed can be consistently maintained to provide accurate image registration between printers or print engines of a tandem printing system. In addition, the need for removal of a driver drum from the printing system, direct measurement of the diameter of the driver drum, and returning the driver drum to the printing system to determine driver drum diameter can be substantially prevented. Consequently, this time consuming and labor intensive process can be avoided. The described setup process can also save a significant amount of time and labor costs when driver drum diameters change over a period of time due to drum wear.

It will be appreciated that various of the above-disclosed and other features, and functions, or alternatives thereof, may be desirably combined into many other different systems or applications. For instance, while the described embodiment includes updating the diameter of the upstream driver drum, it is also possible to instead update the diameter of the downstream driver drum. Various presently unforeseen or unanticipated alternatives, modifications, variations, or improvements therein may be subsequently made by those skilled in the art, which are also intended to be encompassed by the following claims.

What is claimed is:

1. A printing system for printing images on a continuous web comprising:

a first printer configured to print an image on the continuous web, the first printer including a first driver to move the continuous web through the first printer;

a second printer operatively connected to the first printer and configured to print a second image on the continuous web, the second printer including a second driver to move the continuous web through the second printer;

a web buffer operatively connected to the first printer and the second printer to transport the continuous web from the first printer to the second printer, the web buffer including a sensor that generates a signal corresponding to an amount of sag in the continuous web within the web buffer; and a controller operatively connected to the first driver, the sensor, and the second driver, the controller being configured to derive a diameter for one of the first driver and the second driver with reference to the signal from the sensor indicating the change in the amount of sag of the continuous web over a predetermined amount of time and to adjust a rotational speed of at least one of the first driver and the second driver in response to the signal from the sensor indicating a change in the amount of sag of the continuous web at the web buffer that is greater than a predetermined threshold.

2. The printing system of claim 1, the controller being further configured to adjust a rotational speed of at the least one of the first driver and the second driver with reference to the diameter derived for the one of the first driver and the second driver.

3. The printing system of claim 2 wherein the first driver has a first nominal diameter and the second driver has a second nominal diameter and the controller is further configured to derive the diameter for the one of the first driver and second driver by calculating a change in one of the first nominal diameter and the second nominal diameter with reference to the signal generated by the sensor that corresponds to the change in the amount of sag of the continuous web within the web buffer over the predetermined period of time.

4. The printing system of claim 3, the controller being further configured to change one of the first nominal diameter and the second nominal diameter with reference to the change calculated for the one of the first nominal diameter and the second nominal diameter.

5. The printing system of claim 4, the controller being further configured to adjust the rotational speed of the one of the first driver and the second driver to compensate for the change calculated for the one of the first nominal diameter and the second nominal diameter.

* * * * *